United States Patent [19]

Dumora et al.

[11] Patent Number: 4,757,162

[45] Date of Patent: Jul. 12, 1988

[54] RIGID ELECTRICAL INSULATOR INCLUDING A LIGHTLY TEMPERED SODA-LIME GLASS DIELECTRIC

[75] Inventors: Denis Dumora, Vichy; Jean-Paul Parant, Dijon; Laurent Pargamin, Vichy, all of France

[73] Assignee: Ceraver, Paris, France

[21] Appl. No.: 75,250

[22] Filed: Jul. 16, 1987

Related U.S. Application Data

[63] Continuation of Ser. No. 725,712, Apr. 22, 1985, abandoned.

[30] Foreign Application Priority Data

Apr. 20, 1984 [FR] France ..... 84 06301

[51] Int. Cl.[4] ..... H01B 17/20; H01B 17/14

[52] U.S. Cl. ..... 174/195; 174/137 B; 428/410

[58] Field of Search ..... 174/137 R, 137 B, 138 C, 174/165, 194, 195, 202, 209, 210; 65/30.14; 428/410

[56] References Cited

U.S. PATENT DOCUMENTS 3,287,200 11/1966 Hess et al. ..... 428/410

4,471,024 9/1984 Pargamin et al. ..... 65/30.14 X

FOREIGN PATENT DOCUMENTS 0078487 5/1983 European Pat. Off. ..... 65/30.14

OTHER PUBLICATIONS

Riviere, D., "Le Verre Trempe et son Utilisation pour l'Isolement des Lignes Aeriennes à Haute Tension", Technical Brochure of Sediver, Saint-Yorre, Published 1965, 21 pages.

Gardon, R., The Tempering of Flat Glass by Forced Convection, *Reports of the VIIth International Congress on Glass*, Brussels, Jul. 28-30, 1965, pp. 79.1-79.14.

Breton, Jean-Claude, et al., "Les Verres en Electrotechnique", Publication D240 from *Techniques de l'Ingenieur*, Dec. 1976, 16 pages (numbered 11-26).

*Primary Examiner*—Laramie E. Askin

*Attorney, Agent, or Firm*—Sughrue, Mion, Zinn, Macpeak, and Seas

[57] ABSTRACT

Rigid electrical insulator including a soda-lime glass dielectric with an average thickness of 10 to 15 mm, exhibiting a substantially parabolic stress curve, wherein the maximum value of the surface compression stresses at any point in the part falls within the range of 30 to 80 MPa, while the maximum value of the internal tensile stresses at any point in the part falls within the range of 15 to 40 MPa.

3 Claims, 2 Drawing Sheets

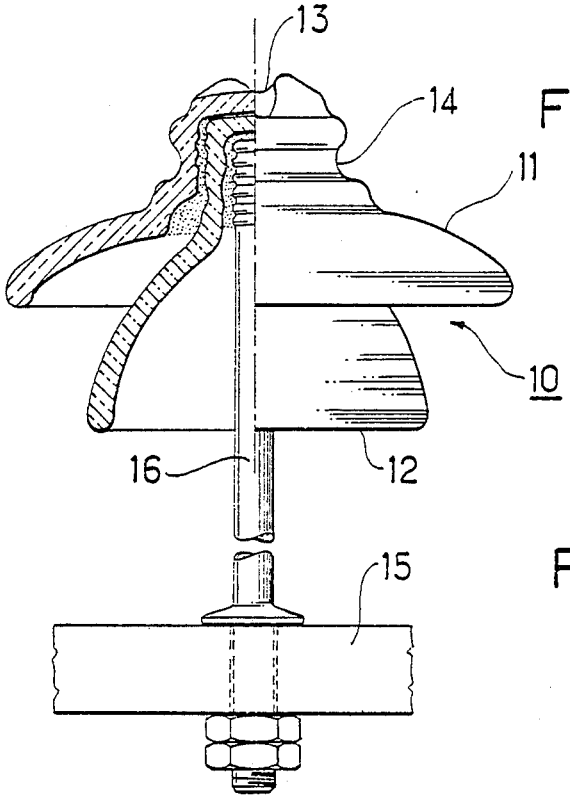
FIG. 3
FIG. 4
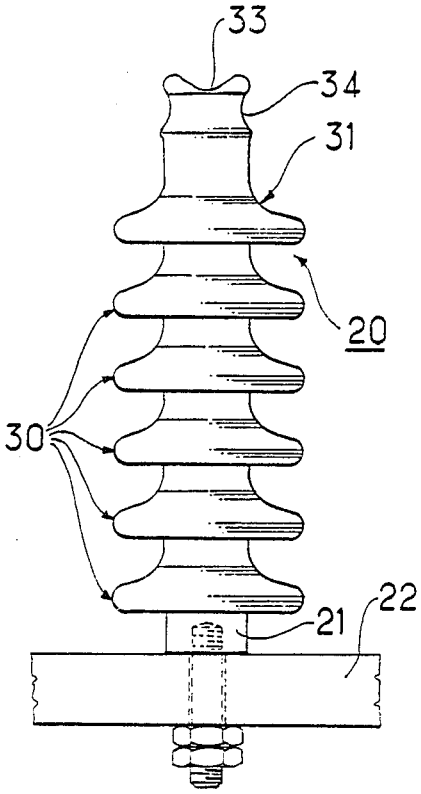

RIGID ELECTRICAL INSULATOR INCLUDING A LIGHTLY TEMPERED SODA-LIME GLASS DIELECTRIC

This is a continuation of application Ser. No. 725,712 filed Apr. 22, 1985 now abandoned.

FIELD OF THE INVENTION

This invention concerns a rigid electrical insulator, especially a high or medium voltage distribution insulator, which includes a lightly tempered soda-lime glass dielectric instead of the annealed or highly heat-tempered soda-lime glass dielectrics that now are commonly used.

BACKGROUND OF THE INVENTION

In some rigid "pin" or "post" type insulators, an electrical cable is attached directly to the head of the dielectric; this implies special mechanical strength requirements for the glass to ensure against accidental breakage of the dielectric head and possible dropping of the cable.

Thus, for certain utilizations, the operating requirements are particularly strict and include resistance to sudden temperature changes on the order of at least 70° C., and an ability to withstand accidental impacts.

Annealed glass dieletrics fail to meet the above-stated temperature specification and afford insufficient impact resistance. Highly thermally tempered glass dielectrics however withstand sudden temperature changes of far more than 100° C. and exhibit very good impact strength due to their very great surface stresses. In fact, a glass of this type, with a thickness of about 10 to 15 mm, exhibits a substantially parabolic stress curve across its thickness: the surface compressive stresses can reach several hundreds of Megapascals and the internal tensile stresses are very nearly half the compressive stresses. Nevertheless, when such a dielectric is impacted with an energy greater than that of the prestressing in the glass, a breakage of the dielectric results.

The present invention is directed to providing a dielectric being free of the latter disadvantage, yet meeting the other requirements mentioned above.

SUMMARY OF THE INVENTION

The present invention provides a rigid electrical insulator having a soda-lime glass dielectric of a material having an average thickness of 10 mm to 15 mm and a substantially parabolic stress curve, wherein the maximum value of surface compression stresses falls within a range of 30 to 80 MPa and the maximum value of internal tensile stresses falls within a range of 15 to 40 MPa, at any point in the part.

An insulator according to the invention is designed to rigidly support an overhead transmission line conductor. Thus, an insulator may be a "pin" type insulator consisting of one dielectric according to the invention or several dielectrics according to the invention attached to one another, such insulator being mounted in a rigid manner on a support by means of a rod or "pin" penetrating into the end dielectric. An insulator may also be a "post" type insulator also consisting of a plurality of dielectrics according to the invention, permanently assembled on a metal base mounted on a support.

Other features and advantages of the invention will be apparent from the following description, supported by the appended drawings given as non-limiting examples for purposes of illustration.

BRIEF DESCRIPTION OF THE DRAWINGS

FIG. 3 is a very basic schematic drawing, partly cut away, of a pin type rigid insulator according to the invention;

and FIG. 4 is a very basic schematic drawing of a post type rigid insulator according to the invention.

DESCRIPTION OF THE PREFERRED EMBODIMENTS

Figure 1:
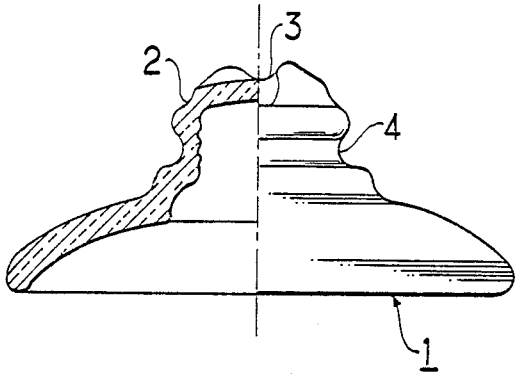
FIG. 1 is a partly cut away schematic drawing of a dielectric according to the invention.
Figure 2:
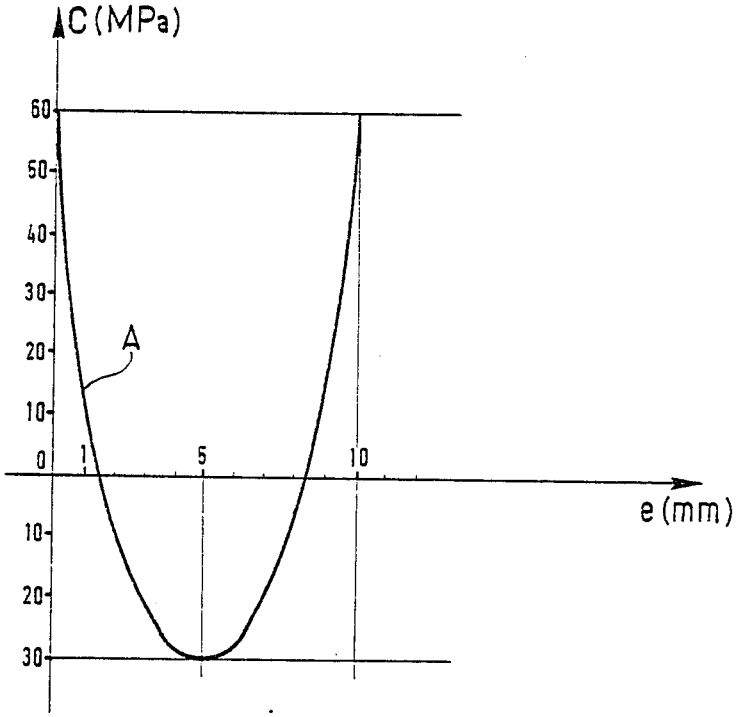
FIG. 2 is a graph of the stress distribution through the thickness of the glass of the dielectric shown in FIG. 1.

FIG. 1 shows a dielectric 1 according to the invention, the head 2 whereof features grooves 3 and 4 for supporting an overhead line condutor. This dielectric is made of soda-lime glass and has an average thickness of about 10 to 15 mm. The distribution of stresses across the glass is plotted in FIG. 2, with the stress values C plotted in Megapascals along the Y-axis and the thickness e plotted in millimeters along the X-axis. Such soda-lime glass having said characteristics and properties and its nature of manufacture and tempering is well known in the art as evidenced, for example, by the publication "Les Techniques de l'Ingenieur" (The techniques of the Engineer), Publication D240 "Les verres en Electrotechnique" (Glass in Electrotechnology), December 1976.

The stress curve A is parabolic. This curve corresponds to the ideal case where the sample plate of glass has parallel sides.

The surface compression stress value can be measured by the method described by D. B. Marshall and B. R. Lawn in "The Journal of the Ceramic Society", Feb. 77, Vol. 60 no. 1-2.

The values of the internal tensile stresses are deduced from the previous values by calculation.

In the given example, the average thickness is 10 mm and the maximum value of the external compression stresses is 60 Megapascals, whereas the maximum value of the internal tensile stresses is 30 Megapascals.

Such a dielectric withstands sudden temperature changes of at least 90° C. Its impact strength is at least three times that of annealed glass. Even in the event of an impact of sufficient force to break off the insulator, no fragmentation of the dielectric occurs.

The same three results also obtain for dielectrics whose maximum surface compressive stress values fall within the range of 30 to 80 Megapascals, with maximum internal tensile stress values in this case being between 15 to 40 Megapascals.

For higher stress values, some fragmentation may begin to appear and for lower stress values the thermal shock and impact strengths become insufficient.

FIGS. 3 and 4 illustrate two very advantageous utilizations of the dielectrics according to the invention.

FIG. 3 shows a rigid pin-type insulator mounted on a support 15. This comprises a first dielectric 11 similar to that of FIG. 1, with two grooves 13 and 14; a second dielectric 12 having the same stress characteristics is attached to dielectric 11. A metal pin 16 secured in the head of dielectric 12 serves to immobilize the insulator 10 as a whole in support 15.

The advantage of the dielectrics according to the invention is obvious when they are subjected to an impact with more energy than their prestressing: instead of total breakage of the dielectric as a whole, there is a clean break of one or more pieces of their skirts, such that the line remains correctly secured on the head of insulator 10.

FIG. 4 shows a rigid insulator 20 mounted on a metal base 21 attached to a support 22. This insulator 20 is made from a plurality of dielectrics 30 according to the invention, stacked and fixed within one another to form a post. The head of the topmost dielectric 31 features two grooves 33 and 34 for an overhead line conductor. In this type of application, fragmentation of two successive dielectrics could cause the conductor to drop. The present invention solves this problem.

It should be understood that the invention is not limited to the two examples of insulators described herein.

What is claimed is:

1. A rigid insulator for supporting an overhead high voltage transmission line, said rigid insulator comprising at least one soda-lime glass dielectric having an average thickness of 10 to 15 mm, exhibiting a substantially parabolic stress curve, and wherein the maximum value of the surface compressive stresses falls within the range of 30 to 80 Megapascals and the maximum value of the internal tensile stresses falls within the range for 15 to 40 MPa, at any point in the part, whereby said soda-lime glass dielectric is capable of withstanding certain temperature ranges of at least 90° C. and has an impact strength which is at least three times that of annealed glass such that in the event of impact of sufficient force to break off the dielectric, no fragmentation of the dielectric occurs.

2. A rigid insulator according to claim 1, wherein said at least one dielectric comprises a plurality of dielectrics, said dielectrics being attached together, and a metal pin attached to the lowermost dielectric.

3. A rigid insulator according to claim 1, wherein said at least one dielectric comprises a plurality of dielectrics stacked to form a post and being fixedly attached to one another, and a base underlying said stack and being fixedly coupled thereto.

* * * * *